US007236713B2

(12) United States Patent
Murakami et al.

(10) Patent No.: US 7,236,713 B2
(45) Date of Patent: Jun. 26, 2007

(54) IMAGE FORMING DEVICE INCLUDING SECONDARY TRANSFER COUNTER ROLLER SWITCHABLE BETWEEN GROUND AND ELECTRICALLY FLOATING STATES TO FACILITATE REMOVAL OF RECORDING MEDIUM FROM INTERMEDIATE TRANSFER MEMBER

(75) Inventors: Susumu Murakami, Kyoto (JP); Yoshie Iwakura, Higashiosaka (JP); Kuniaki Nakano, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 18 days.

(21) Appl. No.: 11/192,820

(22) Filed: Jul. 29, 2005

(65) Prior Publication Data

US 2006/0024073 A1 Feb. 2, 2006

(30) Foreign Application Priority Data

Jul. 30, 2004 (JP) ..... P2004-223946

(51) Int. Cl.
*G03G 15/16* (2006.01)

(52) U.S. Cl. ..... 399/66; 399/44; 399/45; 399/302; 399/308

(58) Field of Classification Search ..... 399/44, 399/45, 66, 302, 308
See application file for complete search history.

(56) References Cited

U.S. PATENT DOCUMENTS 5,565,975 A * 10/1996 Kumon et al. ..... 399/302
6,253,037 B1 * 6/2001 Park ..... 399/44
6,421,521 B2 * 7/2002 Tanaka ..... 399/66

FOREIGN PATENT DOCUMENTS

| | | |
|---|---|---|
| JP | 05-333723 | 12/1993 |
| JP | 08-101590 | 4/1996 |
| JP | 2001-296759 | 10/2001 |
| JP | 2002-108111 | 4/2002 |

* cited by examiner

*Primary Examiner*—David M. Gray
*Assistant Examiner*—Laura K Roth
(74) *Attorney, Agent, or Firm*—David G. Conlin; David A. Tucker; Edwards Angell Palmer & Dodge LLP

(57) ABSTRACT

In an image forming apparatus a primary transfer is carried out such that toner images on a plurality of photoreceptors are transferred and laminated onto an intermediate transfer member, and a recording paper and the intermediate transfer member are sandwiched between a secondary transfer roller disposed so as to be in contact with the intermediate transfer member and a secondary transfer counter roller disposed opposite to the secondary transfer roller, to carry out a secondary transfer that the toner images on the intermediate transfer member are transferred onto the recording paper. At the time, an electric field is applied to the recording paper, and further the secondary transfer counter roller is switched by a switch between grounded state and floating state so that a potential difference between the intermediate transfer member and the secondary transfer roller can be adjusted.

11 Claims, 4 Drawing Sheets

IMAGE FORMING DEVICE INCLUDING SECONDARY TRANSFER COUNTER ROLLER SWITCHABLE BETWEEN GROUND AND ELECTRICALLY FLOATING STATES TO FACILITATE REMOVAL OF RECORDING MEDIUM FROM INTERMEDIATE TRANSFER MEMBER

BACKGROUND OF THE INVENTION

1. Field of the Invention

The present invention relates to an image forming apparatus using an electrophotographic method, in which a primary transfer of once transferring a toner image formed on a photoreceptor to an intermediate transfer member is carried out and thereafter a secondary transfer of transferring a toner image formed on the intermediate transfer member to a recording medium is carried out.

2. Description of the Related Art

Generally, in an image forming apparatus using an electrophotographic method, images are formed through a charging step, an exposure step, a developing step, a transfer step, a fixing step or the like. At the charging step, a surface of a photoreceptor is homogeneously charged in a dark place. At the exposure step, an original image is projected on the charged photoreceptor and thereby, electric charges of a part of the photoreceptor which received light is removed, so that an electrostatic latent image is formed on the surface of the photoreceptor. At the developing step, a toner image is formed by depositing toner as a developer on the electrostatic latent image formed on the photoreceptor. At the transfer step, the toner image formed on the photoreceptor is transferred on a recording medium such as paper and a sheet. At the fixing step the toner image transferred on the recording medium is fixed by heating means, pressurizing means and the like. The image forming apparatus forms a desired image on the recording medium using the electrophotographic method.

It is known that there are mainly two types of color images forming apparatuses which form images with use of toners of a plurality of colors, for instance, toners of four colors such as black, cyan, magenta, and yellow, according to a difference of the transfer step in which toner images of a plurality of colors formed on a plurality of the photoreceptors are transferred to the recording medium such as paper.

One is an image forming apparatus in which toner images of a plurality of colors formed on a plurality of photoreceptors are sequentially transferred directly to the recording medium so that the toner images of the plurality of colors are laminated on the recording medium The color image forming apparatus is an apparatus in which every photoreceptor has a structure to transfer a toner image formed on the photoreceptor to the recording medium. In order to transfer the toner image to the recording medium, it is not necessary to add a new component and therefore, the apparatus does not considerably grow in size. However, even for printing in black-and-white, for instance, even for printing only in black, the recording medium must pass on all the photoreceptors and therefore its printing speed is the same as that in a case of a color printing. Thus, it is not possible to realize high-speed printing. Moreover, since the recording medium must pass on all the photoreceptors, the colors are easily mixed. Further, since the toner images of a plurality of colors formed on the photoreceptors are transferred directly to the recording medium at every photoreceptor, unless conveying speed of the recording medium is exactly controlled, misregistration occurs among the respective color images and it is difficult to adjust registration.

The other is an image forming apparatus in which toner images of a plurality of colors formed on a plurality of photoreceptors are sequentially transferred once on an intermediate transfer member to implement a primary transfer in which the toner images of a plurality of colors are laminated on the intermediate transfer member and thereafter, implemented is a secondary transfer in which the toner images of the plurality of colors are collectively transferred on the recording medium. In such an image forming apparatus, the toner images are laminated on the intermediate transfer member by sequentially transferring the toner images of the plurality of colors to the intermediate transfer member and thereafter, the toner images are collectively transferred to the recording medium. This makes it possible to realize high-speed printing and prevent colors from being easily mixed. Furthermore, without exactly controlling conveying speed of the recording medium, misregistration can be prevented from occurring among the respective color images and it is easy to adjust registration. Therefore, focus of attention has been directed to development of such a color image forming apparatus with use of an intermediate transfer member.

However, there has been a problem related to secondary transfer characteristics of a secondary transfer portion to tend to become unstable according to changes in surface resistance of an intermediate transfer belt caused by environmental factor and the like. An exemplary related art to solve the above-mentioned problem is described in Japanese Unexamined Patent Publication JP-A 5-333723 (1993). The intermediate transfer apparatus of JP-A 5-333723 (1993) is an intermediate transfer apparatus used in an image forming apparatus, in which a backup roller (a secondary transfer counter roller) is used as a conductive roller and further the backup roller is grounded.

Furthermore, there is known as an art similar to the art of JP-A 5-333723 an image forming apparatus having a backup roller grounded via a resister.

Furthermore there is known as another related art an image forming apparatus in which a transfer electric field is changed according to types of the recording medium during the secondary transfer.

However, the secondary transfer characteristics in a secondary transfer portion is adversely affected not only by a cause of fluctuation in surface resistance of the intermediate transfer belt as an intermediate transfer member but also by a cause of unevenness in layer thickness of the toner images laminated on the intermediate transfer member. The layer thickness of the toner images laminated on the intermediate transfer member is not even since, for instance, only unicolor toner images are transferred on some parts while toner images of three colors are transferred on other parts. Therefore, it is difficult to set a transfer condition which is a condition for implementing the secondary transfer. Specifically, optimum values of a transfer electric field which is applied to the recording medium in the secondary transfer differ between a case of a thin and a thick toner image layer on the intermediate transfer member, and it is difficult to set an optimum transfer electric field. That is to say, when the transfer electric field is determined based on a thin layer part of the toner image (a thin layer portion), a thick layer part of the toner image (a thick layer portion) is transferred with less transfer efficiency, and hue of the color images transferred on the recording medium becomes incompatible with desired hue. Besides, when the transfer electric field is determined based on the thick layer portion, the transfer electric field is too strong for the thin layer portion, and therefore, the recording medium is excessively charged with its excess electric field. Therefore, after the toner images formed on the intermediate transfer member are transferred to the recording medium, the recording medium is electrostatically attracted to the intermediate transfer member, with the result of defective peeling that the recording medium is not peeled off the intermediate transfer member. When the defective peeling occurs, the recording medium is conveyed under the condition that the recording medium is attracted to the intermediate transfer member and therefore, the recording medium deviates from a conveying path, which leads a conveying trouble of the recording medium due to the defective peeling, so-called a conveying jam. The conveying jam prominently occurs when the recording medium is thin paper.

In the image forming apparatus using the intermediate transfer member, the thickness of the toner image laminated on the intermediate transfer member is not even and therefore, it is difficult to optimize the transfer electric field which is applied to the recording medium when the toner image on the intermediate transfer member is transferred to recording medium. Therefore, it is desired that, according to the thickness of a toner image on the intermediate transfer member, without changing the transfer electric filed, adequate transfer efficiency with which the toner image on the intermediate transfer member is transferred to the recording medium is fulfilled and further, sufficient peeling performance is provided to peel the recording medium off the intermediate transfer member after the toner image on the intermediate transfer member is transferred to the recording medium.

In order to fulfill the adequate transfer efficiency and provide the sufficient peeling performance, it is necessary that transfer of the toner image between the recording medium and the intermediate transfer member can be carried out, and furthermore a condition for peeling the recording medium off the intermediate transfer member is necessary between the recording medium and the intermediate transfer member.

On the other hand, in the intermediate transfer apparatus of Japanese Unexamined Patent Publication JP-A 5-333723 (1993) or image forming apparatuses of other related arts, there lacks countermeasures according to types of recording medium and environmental changes (such as temperature and humidity) with respect to peeling performance and therefore, the peeling performance cannot sometimes be fulfilled.

Specifically, in a case where the recording medium is a regular paper or a heavy paper the transfer performance can be maintained by grounding the backup roller and then, no peeling trouble occurs since the recording medium is stiff, in other words, it has high stiffness. On the other hand, in a case where the recording medium is thin paper, even when the transfer performance can be maintained in a way that the backup roller is grounded, since the recording medium is not stiff, electrostatic attraction caused by a difference in potential makes the recording medium deviate from the conveying path, and it causes the peeling trouble that the recording medium is conveyed under the condition that the recording medium is attracted to the intermediate transfer member.

SUMMARY OF THE INVENTION

An object of the invention is to provide an image forming apparatus having adequate transfer efficiency to transfer a toner image on an intermediate transfer member to a recording medium and further, sufficient peeling performance to peel the recording medium off the intermediate transfer member.

The invention provides an image forming apparatus comprising:

a plurality of photoreceptors on which toner images are formed;

a traveling intermediate transfer member to which a primary transfer is carried out such that a plurality of toner images are transferred to the traveling intermediate transfer member so as to be laminated thereon;

a secondary transfer roller disposed so as to be in contact with a side of the intermediate transfer member on which the toner images are laminated;

a secondary transfer counter roller disposed so as to confront the secondary transfer roller with the intermediate transfer member disposed inbetween, wherein a secondary transfer of the toner image on the intermediate transfer member to a recording medium which is being conveyed is carried out so that the recording medium and the traveling intermediate transfer member are sandwiched between the secondary transfer roller and the secondary transfer counter roller, further comprising:

switching means for switching the secondary transfer counter roller between grounded state and floating state; and a peeling member for applying an electric field to the recording medium so that the recording medium to which the toner image is transferred can be peeled off the intermediate transfer member.

Further, in the invention, it is preferable that the image forming apparatus further comprises type detecting means for detecting a type of the recording medium, and the switching means switches the secondary transfer counter roller between grounded state and floating state based on the type of the recording medium which is detected by the type detecting means.

Further, in the invention, it is preferable that the switching means switches the secondary transfer counter roller to floating state in a case where the recording medium which is detected by the type detecting means is a thin paper.

Further, in the invention, it is preferable that the switching means switches the secondary transfer counter roller to grounded state in a case where the recording medium which is detected by the type detecting means is a regular paper or a heavy paper.

Further, in the invention, it is preferable that the image forming apparatus further comprises humidity detecting means for detecting humidity inside the image forming apparatus, and the switching means switches the secondary transfer counter roller between grounded state and floating state based on the humidity inside the image forming apparatus which is detected by the humidity detecting means.

Further, in the invention, it is preferable that the switching means switches the secondary transfer counter roller to floating state in a case where the humidity inside the image forming apparatus which is detected by the humidity detecting means is high.

Further, in the invention, it is preferable that the switching means switches the secondary transfer counter roller to grounded state in a case where the humidity inside the image forming apparatus which is detected by the humidity detecting means is low.

Further, in the invention, it is preferable that the peeling member is constituted so that electrical field can be uniformly applied to the recording medium.

Further, in the invention, it is preferable that the switching means is composed of a relay or solenoid.

Further, in the invention, it is preferable that the secondary transfer counter roller is a conductive roller.

Further, in the invention, it is preferable that the secondary transfer roller is constituted so that transfer electrical field applied to the recording medium becomes constant in order to transfer the toner images laminated on the intermediate transfer member to the recording medium.

According to the invention, the primary transfer is carried out such that the plurality of toner images formed on a plurality of the photoreceptors are respectively transferred to the traveling intermediate transfer member so as to be thereon. Thereafter, the secondary transfer of the toner image on the intermediate transfer member to a recording medium which is being conveyed is carried out so that the recording medium and the traveling intermediate transfer member are sandwiched between the secondary transfer roller and the secondary transfer counter roller. The secondary transfer roller is disposed so as to be in contact with a side of the intermediate transfer member on which the toner images are laminated. The secondary transfer counter roller is disposed so as to confront the secondary transfer roller with the intermediate transfer member disposed inbetween. Further, the electrical field is applied to the recording medium by the peeling member. Furthermore, when the secondary transfer is carried out, the electrical field is applied to the recording medium by the secondary transfer roller.

In most cases, the secondary transfer counter roller is brought to grounded state so that adequate transfer efficiency is fulfilled and sufficient peeling performance is provided.

In particular, in a case where it is difficult for the recording medium to be peeled off the intermediate transfer member, the secondary transfer counter roller is switched from grounded state to floating state by the switching means. Thus, the recording medium is conveyed without being attracted to the intermediate transfer member. Therefore, the recording medium can be peeled off the intermediate transfer member, and sufficient peeling performance can be provided.

When the secondary transfer counter roller is maintained in floating state, the secondary transfer counter roller is unnecessarily charged, which deteriorates transfer efficiency. Therefore, by the switching means, the secondary transfer counter roller is switched to grounded state except during the secondary transfer. Thus, it is possible to prevent the transfer efficiency from deteriorating.

Consequently, it is possible to fulfill adequate transfer efficiency and further, provide sufficient peeling performance.

Further, according to the invention, on the basis of a type of the recording medium which is detected by the type detecting means for detecting a type of the recording medium, the switching means switches the secondary transfer counter roller between grounded state and floating state. In particular, in a case where a type of the recording medium is a recording paper which is difficult to be peeled off the intermediate transfer member, the secondary transfer counter roller is switched to floating state by the switching means. Thus, the recording medium is conveyed without being attracted to the intermediate transfer member. Therefore, the recording medium can be peeled off the intermediate transfer member, and sufficient peeling performance can be provided.

Further, according to the invention, in a case where the recording medium which is detected by the type detecting means is a thin paper, it is difficult for the thin paper which is not stiff to be peeled off the intermediate transfer member. The secondary transfer counter roller is switched to floating state by the switching means so that the thin paper is conveyed without being attracted to the intermediate transfer member. Therefore, the thin paper can be peeled off the intermediate transfer member, and sufficient peeling performance can be provided.

Further, according to the invention, in a case where the recording medium which is detected by the type detecting means is a regular paper or a heavy paper, it is easy for the regular paper or heavy paper which is stiff to be peeled off the intermediate transfer member and therefore, sufficient peeling performance is provided. Further, the secondary transfer counter roller is switched to grounded state by the switching means so that more adequate transfer efficiency can be fulfilled.

Further, according to the invention, on the basis of the humidity inside the image forming apparatus which is detected by the humidity detecting means for detecting the humidity inside the image forming apparatus, the switching means switches the secondary transfer counter roller between grounded state and floating state. In particular, in a case where the humidity inside the image forming apparatus is a degree on which it is difficult for the recording medium and the intermediate transfer member to be peeled off each other, the secondary transfer counter roller is switched to floating state by the switching means. Thus, the recording medium is conveyed without being attracted to the intermediate transfer member. Therefore, the recording medium can be peeled off the intermediate transfer member, and sufficient peeling performance can be provided.

Further, according to the invention, in a case where the humidity inside the image forming apparatus which is detected by the humidity detecting means is high, the recording medium loses its stiffness by moisture absorption and is easily electrostalically attracted, which makes difficult to be peeled off the intermediate transfer member. The secondary transfer counter roller is switched to floating state by the switching means. Thus, the recording medium is conveyed without being attracted to the intermediate transfer member. Therefore, the recording medium can be peeled off the intermediate transfer member, and sufficient peeling performance can be provided.

Further, according to the invention, in a case where the humidity inside the image forming apparatus which is detected by the humidity detecting means is low, an electric resistance value of the recording medium increases, an electric current is difficult to flow, and therefore-transfer efficiency is deteriorated. The second transfer counter roller is switched to grounded state by the switching means so that more adequate transfer efficiency can be fulfilled.

Further, according to the invention, the peeling member can apply the electrical field uniformly to the recording medium and therefore, electricity of the recording medium can be homogeneously removed and sufficient peeling performance can be provided.

Further, according to the invention, the switching means is composed of a relay or solenoid. Thus, it is possible to switch the secondary transfer counter roller between grounded state and floating state.

Further, according to the invention, since the secondary transfer counter roller is the conductive roller, it is possible to adjust a potential difference between the recording medium and the intermediate transfer member. Therefore, adequate transfer efficiency can be fulfilled and sufficient peeling performance can be provided.

Further, according to the invention, since the secondary transfer roller is constituted so that transfer electrical field applied to the recording medium becomes constant in order to transfer the toner images laminated on the intermediate transfer member to the recording medium, adequate transfer efficiency can be fulfilled.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
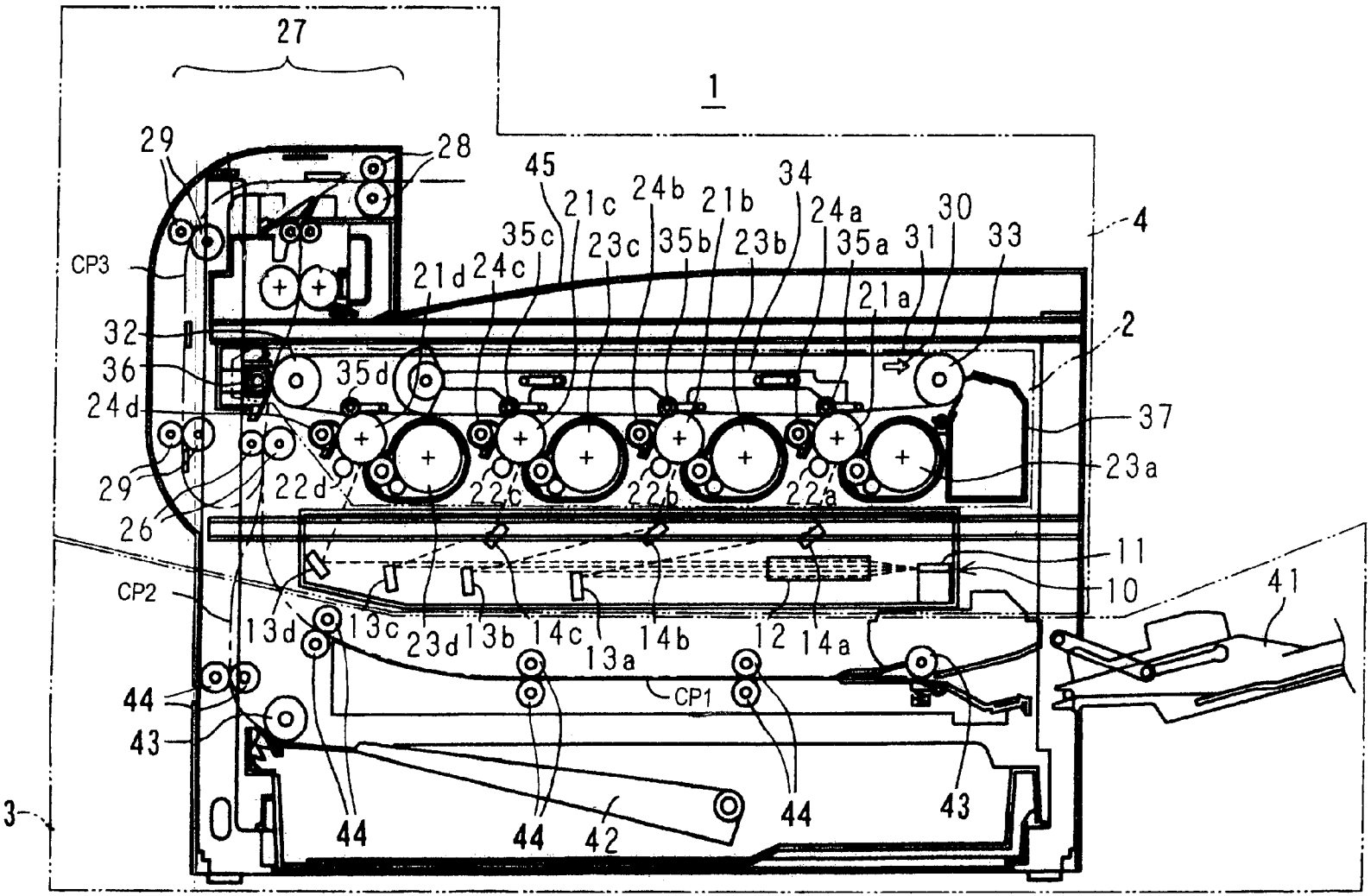
FIG. 1 is a schematic cross sectional view showing a constitution of an image forming apparatus according to an embodiment of the invention.

Now referring to the drawings, preferred embodiments of the invention are described below.

Figure 2:
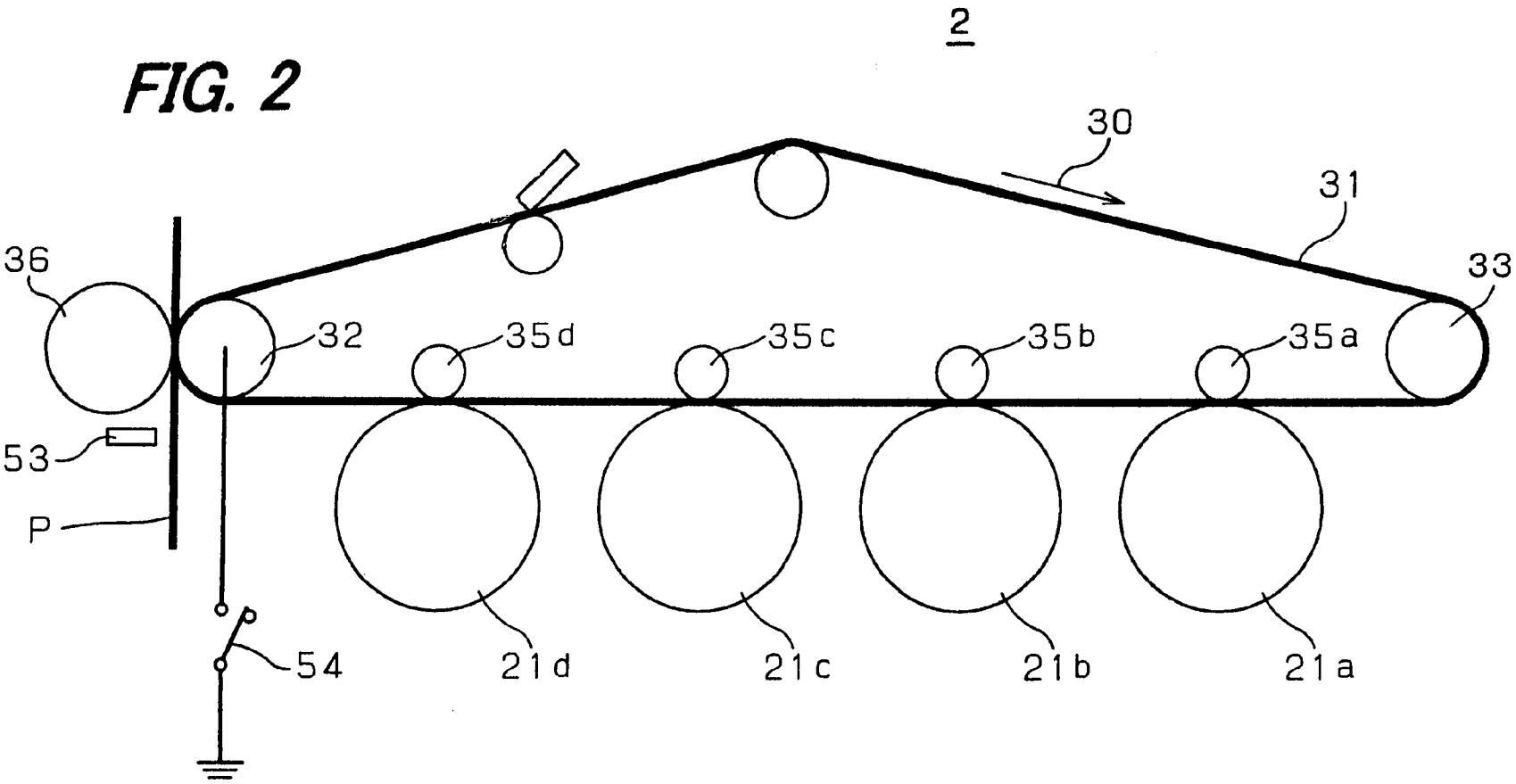
FIG. 2 is a cross sectional view showing a simplified constitution of an intermediate transfer unit provided in the image forming apparatus.

FIG. 1 is a schematic cross sectional view showing a constitution of an image forming apparatus 1 according to an embodiment of the invention, and FIG. 2 is a cross sectional view showing a simplified constitution of an intermediate transfer unit 2 provided in the image forming apparatus 1. The image forming apparatus 1 shown in FIG. 1 is specifically a digital color printer which is one of image forming apparatuses, and toners used to form images are toners of four colors: yellow (Y), magenta (M), cyanine (C) and black (K). The image forming apparatus 1 is provided with the intermediate transfer unit 2, arranged on an exterior of an information processing apparatus (not shown) such as a personal computer and connected to the information processing apparatus. Then, toner images formed according to color component image information for four colors obtained by treatment of the objective image information are once transferred respectively to the intermediate member, thereby toner images are laminated, and thereafter the laminated toner images are correctively transferred to the recording medium such as a paper. A multicolor image or single color image is thus formed on the recording medium.

Firstly, a description will be given below as to a constitution and operation of the image forming apparatus 1 provided with the intermediate transfer unit 2.

The image forming apparatus 1 has a constitution comprising a paper feeding unit 3 and an image forming unit 4.

Now, a constitution of the paper feeding unit 3 will be described. The paper feeding unit 3 is disposed at the bottom of the image forming unit 4 and comprises a manual tray 41, a paper feeding cassette 42, a separating roller 43 and the like. The manual tray 41 and the paper feeding cassette 42 house a recording paper P which is the recording medium. The separating roller 43 feeds the recording paper P housed in the manual tray 41 or the paper feeding cassette 42 sheet by sheet separately into a conveying path CP1 of the recording paper P.

An operation of the paper feeding unit 3 will be described. In a case where the recording paper P housed in the manual tray 41 is used, the paper feeding unit 3 feeds the recording paper P housed in the manual tray 41 sheet by sheet into the conveying path CP1 by the separating roller 43 and conveys the recording paper P to the image forming unit 4 by conveying rollers 44 provided in various places on the conveying path CP1. Further, in a case where the recording paper P housed in the paper feeding cassette 42 is used, the paper feeding unit 3 feeds the recording paper P housed in the paper feeding cassette 42 sheet by sheet into a conveying path CP2 by the separating roller 43 and conveys the recording paper P to the image forming unit 4 by the conveying rollers 44 disposed in the conveying path 82 CP2.

A constitution of the image forming unit 4 will be described. The image forming unit 4 is disposed on the top of the paper feeding unit 3 and comprises the intermediate transfer unit 2, an exposure unit 10, registration rollers 26, a fixing unit 27, paper discharging rollers 28, a catch tray 45, and the like. A detailed description will be given hereinafter as to a constitution and an operation of the intermediate transfer unit 2 and exposure unit 10. The exposure unit 10 emits a laser beam to the intermediate transfer unit 2 on the basis of the image information, and the intermediate transfer unit 2 transfers a toner image which corresponds to the image information to the recording paper P by means of the laser beam emitted by the exposure unit 10. The registration rollers 26 control paper feeding timing of the recording paper P conveyed from the paper feeding unit 3, and convey the recording paper P to the intermediate transfer unit 2. The fixing unit 27 fixes the toner images transferred onto the recording paper P to the recording paper P and forms images on the recording paper P. The paper discharging rollers 28 discharge the recording paper P, on which the images are formed, to the catch tray 45, and convey the recording paper P, on which the images are formed, to the conveying path CP3.

The image forming unit 4 will be described. The image forming unit 4 controls paper feeding timing of the recording paper P by the registration rollers 26 so that the toner images transferred by the intermediate transfer unit 2 can be located at a preferable position of the recording paper P, and conveys the recording paper P conveyed from the paper discharging unit 3 to the intermediate transfer unit 2. By the intermediate transfer unit 2, the toner images are transferred to the recording paper P. The toner images are fixed by the fixing unit 27 and thus, images are formed. Then, In a case of a one-side printing in which an image is formed only on one side of the recording paper P, in the image forming unit 4, the recording paper P on which the image is formed, is discharged to the catch tray 45 by the paper discharging rollers 28. Further, in the case of double-side printing in which both sides of the recording paper P are printed, in the image forming unit 4, before the recording paper P on which an image has been formed is discharged to the catch tray 45 by the paper discharging rollers 28, the recording paper P is fed into a conveying path CP3 by reversely rotating the paper discharging rollers 28. The recording paper P is further conveyed to the registration rollers 26 by conveying rollers 29 disposed in the conveying path CP3 and an image is formed on the recording paper P again, and thereafter the recording paper P is discharged to the catch tray 45 by the paper discharge rollers 28.

A constitution of the intermediate transfer unit 2 will be described. The intermediate transfer unit 2 comprises photoreceptors 21*a*, 21*b*, 21*c* and 21*d*, charging devices 22*a*, 22*b*, 22*c* and 22*d*, developing devices 23*a*, 23*b*, 23*c* and 23*d*, cleaning members 24*a*, 24*b*, 24*c* and 24*d*, an intermediate transfer member 31, a secondary transfer counter roller 32, a driving roller 33, an intermediate transfer member tension mechanism 34, primary transfer rollers 35*a*, 35*b*, 35*c* and 35*d*, a secondary transfer roller 36 and an intermediate transfer member cleaning member 37. The intermediate transfer unit 2 further comprises a peeling member, a switch and the like which are not shown in FIG. 1.

The photoreceptors 21*a* to 21*d* are disposed so as to be in contact with the traveling intermediate transfer member 31. The photoreceptors 21*a* to 21*d* are photoreceptors for forming toner images of Y, M, C, and K in the order from an upstream of the intermediate transfer member 31, respectively. Hereinafter, in FIG. 1 and FIG. 2, additional characters in alphabet from "a", "b", "c" and "d" indicate members respectively corresponding to each color of Y, M, C, and K. The charging devices 22*a* to 22*d* are disposed so as to be respectively in contact with the photoreceptors 21*a* to 21*d*, and surfaces of the photoreceptors 21*a* to 21*d* are homogeneously charged to a predetermined potential. Specifically, a roller charging device is used, but the roller charging device may be replaced with a brush charging device and a charger type charging device. The developing devices 23*a* to 23*d* are disposed so as to be respectively contact with the photoreceptors 21*a* to 21*d*, and respectively house the toners of Y, M, C, and K. The developing devices 23*a* to 23*d* supply the toners to electrostatic latent images formed on surfaces of the photoreceptors 21*a* to 21*d*, and the toner images are formed on the photoreceptors 21*a* to 21*d*. The cleaning members 24*a* to 24*d* are constituted so as to be respectively in contact with the photoreceptors 21*a* to 21*d*. After the toner images on the photoreceptors 21*a* to 21*d* are transferred to the intermediate transfer member 31, the cleaning members 24*a* to 24*d* collect and remove the toners left on the surfaces of the photoreceptors 21*a* to 21*d*.

The intermediate transfer member 31 is stretched by the secondary transfer counter roller 32, the driving roller 33, the intermediate transfer member tension mechanism 34, and the primary transfer rollers 35*a* to 35*d*, and disposed so as to be in contact with the photoreceptors 21*a* to 21*d*. The respective toner images formed on the photoreceptors 21*a* to 21*d* are sequentially transferred so that toner images of a plurality of colors are formed on the intermediate transfer member 31. Specifically, a film having a thickness of about 75 μm to 120 μm is used in the intermediate transfer member 31. The driving roller 33 rotates so as to make the intermediate transfer member 31 travel in a direction of an arrow 30 shown in the figure. The intermediate transfer member tension mechanism 34 is composed of a tension roller and the like, and the tension roller and the like adjust a course where the intermediate transfer member 31 travels so that the photoreceptors 21*a* to 21*d* having no toner images for the secondary transfer and the intermediate transfer member 31 do not touch. The primary transfer rollers 35*a* to 35*d* are disposed opposite to the photoreceptors 21*a* to 21*d* via the intermediate transfer member 31. The primary transfer roller 35*a* to 35*d* transfer the toner images formed on the surfaces of the photoreceptors 21*a* to 21*d* to the intermediate transfer member 31 by applying the electrical field to the intermediate transfer member 31. The primary transfer rollers 35*a* to 35*d* are rollers in which a metal shaft (e.g., stainless-steel) having a diameter of 8 mm to 10 mm is used as a cored bar whose surface is covered with a conductive elastic material such as ethylene propylene diene (EPDM) rubber and urethane foam, and the electrical field can be homogeneously applied to the intermediate transfer member 31.

The secondary transfer roller 36 is disposed opposite to the secondary transfer counter roller 32 via the intermediate transfer body 31. The secondary transfer roller 36 transfers the toner images formed on the intermediate transfer member 31 to the recording paper P by applying the transfer electrical field to the recording paper P which is conveyed between the intermediate transfer member 31 and the secondary transfer roller 36. The secondary transfer roller 36 is a roller in which a metal shaft such as stainless-steel having a diameter of 8 mm to 10 mm is used as a cored bar whose surface is covered with a conductive elastic material such as EPDM rubber and urethane foam, and the electrical field can be homogeneously applied to the recording paper P. The secondary transfer counter roller 32 is disposed opposite to the secondary transfer roller 36 via the intermediate transfer member 31. The secondary transfer counter roller 32 is a conductive roller and constituted so as to electrically switch between a grounded state and floating state. For instance, the conductive roller may be a roller in which a metal shaft such as aluminum is used as a cored bar whose surface is covered with a conductive elastic material such as EPDM rubber and urethane foam, or a metallic roller which is not covered with an elastic material. With respect to the secondary transfer counter roller 32, in a case where importance is attached to a driving performance thereof, desired is the roller which is covered with an elastic material, whereas in a case where importance is attached to an accuracy of the registration adjustment, desired is a metallic roller. Moreover, the secondary transfer counter roller 36 may be a roller in which a metal shaft such as aluminum is used as a cored bar whose surface is covered with an insulating elastic material. The intermediate transfer cleaning member 37 is disposed so as to be in contact with the intermediate transfer member 31. After the toner images on the intermediate transfer member 31 are transferred to the recording paper P, the intermediate transfer cleaning member 37 collects and removes the toners left on the surfaces of the intermediate transfer member 31.

An operation of the intermediate transfer unit 2 will be described. Firstly, the intermediate transfer unit 2 forms the toner images on the photoreceptors 21*a* to 21*d*. Specifically, the photoreceptors 21*a* to 21*d* are respectively homogenously charged by the charging devices 22*a* to 22*d*. Electricity is removed from a portion where it is not necessary to form toner images by emitting a laser beam based on the image information from the exposure unit 10 to the each charged photoreceptor 21*a* to 21*d*. Thereby, electrostatic latent images based on the image information are formed on the surfaces of the photoreceptors 21*a* to 21*d*. Toners having electric charges are supplied on the photoreceptors 21*a* to 21*d* by the developing devices 23*a* to 23*d*, and the toner images based on the image information are formed on the photoreceptors 21*a* to 21*d*. Next, the intermediate transfer unit 2 carries out the primary transfer in which the toner images on the photoreceptors 21*a* to 21*d* are sequentially transferred by the primary transfer rollers 35*a* to 35*d* to the intermediate transfer member 31 which is traveled by the driving roller 33 and whose traveling course is determined by the intermediate transfer member tension mechanism 34. Finally, the recording paper P which is being conveyed and the traveling intermediate transfer member 31 are sandwiched between the secondary transfer roller 36 and the secondary transfer counter roller 32, and the intermediate transfer unit 2 applies the electrical field (transfer electrical field) to the recording paper P by the secondary transfer roller 36. Thus, it is possible to carry out the secondary transfer in which the toner images formed on the intermediate transfer member 31 are collectively transferred to the recording paper P.

A constitution of the exposure unit 10 will be described. The exposure unit 10 comprises a laser exposure unit 11, a polygon mirror 12, reflecting mirrors 13*a*, 13*b*, 13*c* and 13*d* and 14*a*, 14*b*and 14*c*, and the like. The laser exposure unit 11 emits a laser beam according to color component image information of four colors of Y, M, C, and K which is obtained by treatment of the objective image information. By means of the reflecting mirrors 13*a* to 13*d* and 14*a* to 14*c*, the intermediate transfer unit 2 is exposed to each laser beam corresponding to the color component image information for each color which laser beam is emitted by the laser exposure unit 11 and is reflected on the polygon mirror 12. For instance, in the case of Y, a laser beam corresponding to the color component image information for Y which is reflected on the polygon mirror 12 is made to reflect on the reflecting mirror 13*a*, and to further reflect on the reflecting mirror 14*a* so that the photoreceptor 21*a* of the intermediate transfer unit 2 is exposed to the laser beam. Further, the exposure unit 10 may be constituted by using a writing head wherein light emitting elements such as an EL (electroluminescence) element or an LED (light emitting diode) are disposed in an array, instead of the laser exposure unit 11.

Further, a detailed description will be given with reference to FIG. 2 as to the secondary transfer of operations of the intermediate transfer unit 2. FIG. 2 is a cross sectional view showing a simplified constitution of an intermediate transfer unit 2 provided in the image forming apparatus 1. In FIG. 2, the charging devices 22*a* to 22*d*, the developing devices 23*a* to 23*d*, and cleaning members 24*a* to 24*d* are omitted while the peeling member 53 and the switch 54 which are not shown in FIG. 1 are shown. The peeling member 53 is located so as not to block the conveyance of the recording paper P, and disposed so as to be substantially parallel to the conveying path of the recording paper P. Further, in order not to cause deterioration of print quality by grazing the recording paper P, the peeling member 53 is a flat plate disposed close to the conveying path so as not to be in contact with the recording paper P conveyed into the conveying path. The peeling member 53 applies a uniform electrical field to the recording paper P. Thus, the recording paper P in which the secondary transfer is finished, can be prevented from being attracted to the intermediate transfer member 31 and deviating from the conveying path, in other words, it is possible to sufficiently show the peeling performance that the recording paper P is peeled off the intermediate transfer member 31. Further, the switch 54 is connected to a housing of the image forming apparatus 1 and the secondary transfer counter roller 32. The switch 54 can switch the secondary transfer counter roller 32 between grounded state and floating state according to an environment such as humidity and a type of the recording paper, and the switch 54 is specifically a relay or solenoid. Here, the switch 54 is electrically connected to the secondary transfer counter roller 32 by connecting the switch 54 to a conductive bearing for supporting the secondary transfer counter roller 32. The switching means is composed of the switch 54.

The intermediate transfer unit 2 applies the electrical field (the peeling electrical field) by the peeling member 53 to the recording paper P which has been conveyed through the conveying path so that the recording paper P is charged in the same polarity as the charged intermediate transfer member 31, in other words, the recording paper P has an electric charge of an opposite polarity to electric charges which the toners have. Thus, after the secondary transfer is carried out, the recording paper P is conveyed without being attracted to the intermediate transfer member 31, therefore being peeled off the intermediate transfer member 31. It is preferable that the peeling electrical field is 20% or more and 50% or less of the electrical field (the secondary transfer electrical field) applied from the secondary transfer roller 36 to the recording paper P during the secondary transfer. When the peeling electrical field is smaller than 20%, it is not possible to sufficiently show the peeling performance for peeling the recording paper P off the intermediate transfer member 31. When the peeling electrical field is larger than 50%, the recording paper P has too many electric charges, which adversely affects the transfer efficiency that the toner images are transferred to the recording paper P. Further, the intermediate transfer unit 2 applies the peeling electrical field to the recording paper P and carries out the primary transfer in which the toner images on the photoreceptors 21*a* to 21*d* to the intermediate transfer member 31 by the primary transfer rollers 35*a* to 35*d*. The intermediate transfer unit 2 makes the intermediate transfer member 31 on which the toner images are formed, travel in a direction of the arrow 30 by the driving roller 33.

Next, the intermediate transfer unit 2 further conveys the recording paper P, and the recording paper P and the traveled intermediate transfer member 31 are sandwiched between the secondary transfer roller 36 and the secondary transfer counter roller 32. The electric field is applied to the recording paper P by the secondary transfer roller 36 so that the recording paper P is charged in the same polarity as the transfer member 31 in which an amount of the electric charge of the recording paper P is larger than that of the intermediate transfer member 31. Thus, the toner images are transferred to the recording paper P. At the time, on the basis of a type of the recording paper P and an environment such as humidity inside the image forming apparatus 1, the secondary transfer counter roller 32 switched between grounded state and floating state by the switch 54. Inmost cases, by switching the secondary transfer counter roller 32 to grounded state, adequate transfer efficiency is fulfilled and sufficient peeling performance is provided. In particular, in a case where it is difficult to peel the recording paper P off the intermediate transfer member 31, the secondary transfer counter roller 32 is switched to floating state by switching off the switch 54. Thus, the recording paper P is conveyed without being attracted to the intermediate transfer member 31. Therefore, the recording medium can be peeled off the intermediate transfer member 31, and sufficient peeling performance is provided. When the secondary transfer counter roller 32 is maintained in floating state, the secondary transfer counter roller 32 is unnecessarily charged, which deteriorates transfer efficiency. Therefore, the switch 54 is switched on to maintain the secondary transfer counter roller 32 in a grounded state except during the secondary transfer. Thus, it is possible to prevent the transfer efficiency from deteriorating. As described above, adequate transfer efficiency can be fulfilled and further, sufficient peeling performance can be provided.

Specifically, on the basis of a type of the recording paper P detected by the type detecting means for detecting a type of the recording medium, the secondary transfer counter roller 32 is switched between grounded state and floating state by the switch 54. It is difficult for a thin paper which is not stiff to be peeled off the intermediate transfer member 31. In a case where the recording paper P detected by the type detecting means is a thin paper, the secondary transfer counter roller 32 is switched to floating state by switching off the switch 54. Thus, the recording paper P is conveyed without being attracted to the intermediate transfer member 31. Therefore, the recording paper P can be peeled off the intermediate transfer member 31, and sufficient peeling performance can be provided. Moreover, in a case where the recording paper P detected by the type detecting means is a regular paper or a heavy paper, it is easy for the regular paper or heavy paper which is stiff to be peeled off the intermediate transfer member 31 and therefore, sufficient peeling performance is provided. Further, the secondary transfer counter roller 32 is switched to grounded state by switching on the switch 54. Thus, more adequate transfer efficiency can be fulfilled.

The information processing apparatus connected to the image forming apparatus 1 outputs image information to the image forming apparatus 1 and also outputs a type of a recording medium inputted by a user to the image forming apparatus 1. The image forming apparatus 1 recognizes a result outputted by the information processing apparatus and detects the type of the recording medium. The type detecting means is means for recognizing a type of the recording paper P inputted to the information processing apparatus by a user and detecting a type of a recording medium. Moreover, the type detecting means may be means for detecting a type of a recording medium on the basis of basic weight calculated from the measured weight and dimension. In the type detecting means, weight of a recording medium is measured by a weight sensor, and further dimension of a recording medium is measured by a sensor which measures length and width of a recording medium. At the point, when the basic weight of a paper is 54 g/cm$^2$ or less, the paper is recognized as a thin paper, and when the basic weight of a paper exceeds 54 g/cm$^2$, the paper is recognized as a regular paper or a heavy paper.

Further, in a case where a type of the recording paper P is not recognized, on the basis of a detected result of humidity detecting means for detecting humidity inside the image forming apparatus 1, the second transfer counter roller 32 is switched between grounded state and floating state by the switch 54. In a case where humidity detected by the humidity detecting means is high inside the image forming apparatus 1, the recording paper P loses its stiffness by moisture absorption and is easily electrostatically attracted, which makes difficult to be peeled off the intermediate transfer member 31. The secondary transfer counter roller 32 is switched to floating state by switching off the switch 54. Thus, the recording paper P is conveyed without being attracted to the intermediate transfer member 31. Therefore, the recording paper P can be peeled off the intermediate transfer member 31, and sufficient peeling performance can be provided. Moreover, in a case where humidity detected by the humidity detecting means is low inside the image forming apparatus 1, an electric resistance value of the recording medium increases, an electric current is difficult to flow, and therefore the transfer efficiency is deteriorated. The secondary transfer counter roller 32 is switched to grounded state by switching on the switch 54. Thus, more adequate transfer efficiency can be maintained.

The humidity detecting means is composed of a humidity sensor and detects humidity inside the image forming apparatus 1. The humidity sensor is disposed, for instance, inside the intermediate transfer unit 2. At the time, when the detected humidity is lower than 80% at relative humidity, humidity inside the image forming apparatus 1 is recognized as low humidity, whereas when the detected humidity is 80% or higher at relative humidity, humidity inside the image forming apparatus 1 is recognized as high humidity.

Figure 3:
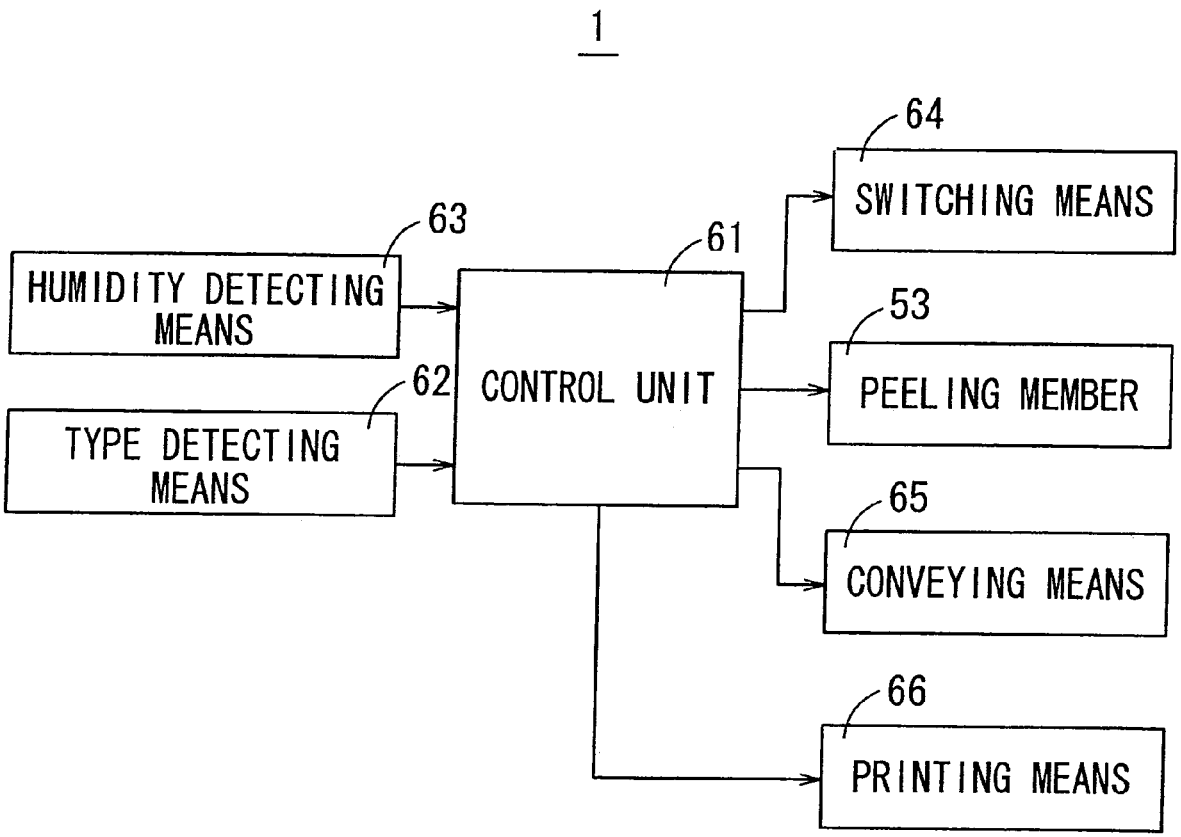
FIG. 3 is a block diagram showing an electrical constitution of the image forming apparatus according to the embodiment of the invention.

FIG. 3 is a block diagram showing an electrical constitution of the image forming apparatus 1 according to the embodiment of the invention. The image forming apparatus 1 comprises a control unit 61, type detecting means 62, humidity detecting means 63, switching means 64, conveying means 65, the peeling member 53, and printing means 66. This block diagram shows a main constitution of the image forming apparatus 1, and the image forming apparatus 1 may have a constitution which further comprises other means. The control unit 61 performs a control of the whole image forming apparatus 1. The type detecting-means 62 detects a type of the recording paper P. The humidity detecting means 63 detects humidity inside the image forming apparatus 1. The switching means 64 switches the secondary transfer counter roller 32 between grounded state and floating state based on a detected result of the type detecting means 62 and the humidity detecting means 63. The conveying means 65 conveys the recording paper P from the paper feeding unit 3 to the image forming unit 4, and further discharges the recording paper P to the catch tray 45. The peeling member 53 prevents the recording paper P in which the secondary transfer is finished from being attracted to the intermediate transfer member 31 and deviating from the conveying path by applying the uniform electrical field to the recording paper P. The printing means 66 forms an image on the recording paper P by transferring and fixing the toner image corresponding to the image information to the recording paper P which is conveyed by the conveying means 65.

Figure 4:
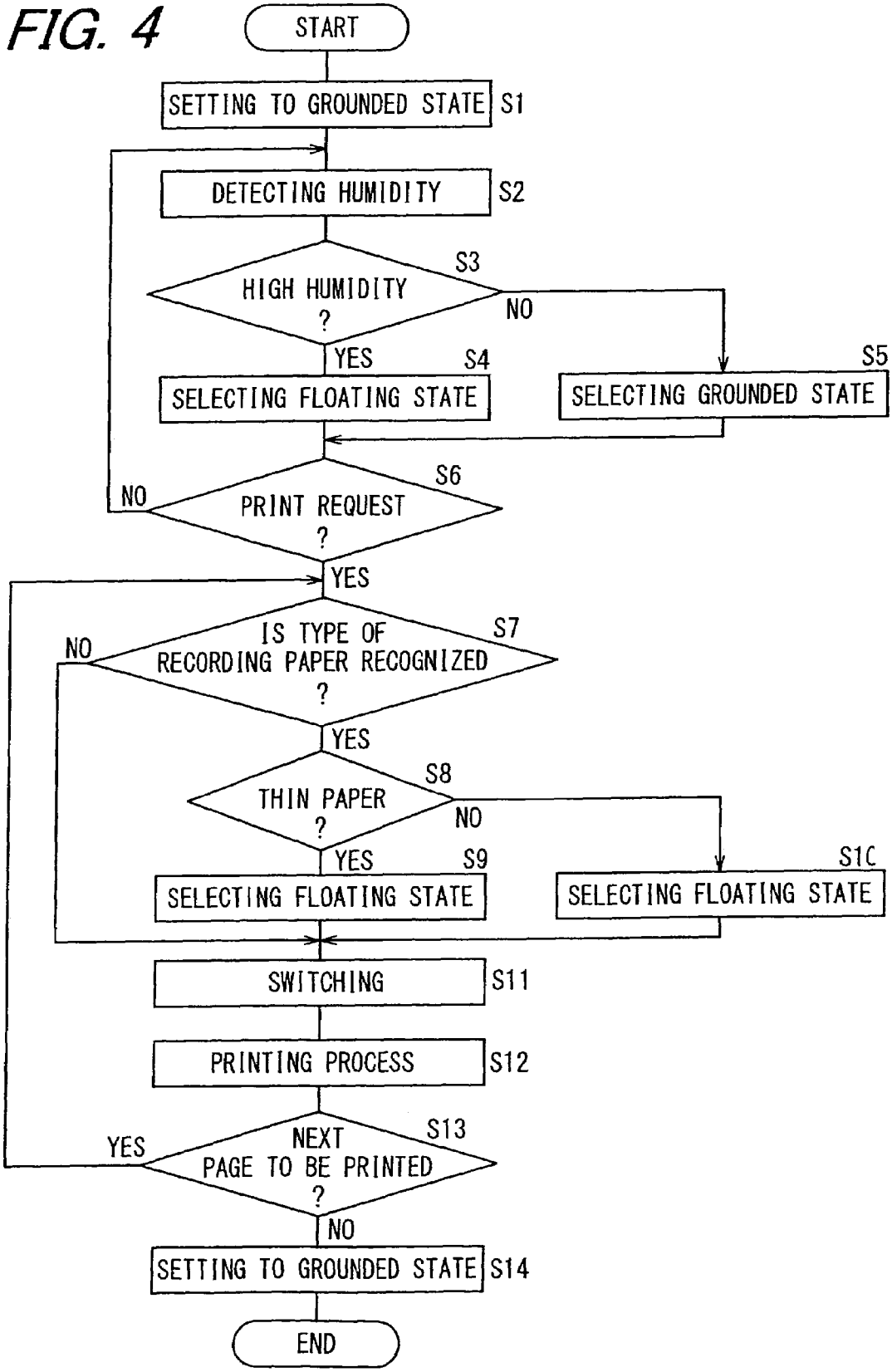
FIG. 4 is a flowchart showing a switching procedure of a secondary transfer counter roller between grounded state and floating state.

FIG. 4 is a flowchart showing an example of an image forming process of the image forming apparatus 1 according to the embodiment of the invention. The image forming apparatus 1 is switched on, and then a process starts as step S1. At step S1, the control unit 61 sets the secondary transfer counter roller 32 to grounded state, and the procedure proceeds to step S2. At step S2, humidity inside the image forming apparatus 1 is detected by the humidity detecting means 63, and the procedure proceeds to step S3. At step S3, when the humidity inside the image forming apparatus 1, which is detected by the humidity detecting means 63 is recognized as high humidity, the procedure proceeds to step S4, whereas when the detected humidity inside the image forming apparatus 1 is recognized as low humidity, the procedure proceeds to step S5. At step S4, the control unit 61 selects floating state, and the selected result is saved in a memory inside the apparatus, and then the procedure proceeds to step S6. At step S5, the control unit 61 selects grounded state, and the selected result is saved in the memory inside the apparatus, and then the procedure proceeds to step S6. At step S6, when a print request is recognized by the control unit 61, the procedure proceeds to step S7, whereas when the print request is not recognized, the procedure goes to step S2. The print request is recognized by recognizing, for instance, whether the print request inputted in the information processing apparatus connected to the image forming apparatus 1 is inputted from the image forming apparatus 1 to the information processing apparatus. The humidity is, for instance, detected every set time until the print request is recognized. On the basis of the humidity, grounded state or floating state is selected in the secondary transfer counter roller 32. At step S7, when a type of the recording paper P is recognized by the type detecting means 62, the procedure proceeds to step S8, whereas when a type of the recording paper P is not recognized, the procedure proceeds to step S11. For instance, on the basis of a user's input, a type of the recording paper P is recognized.

At step S8, when a type of the recording paper P, which is recognized by the type detecting means 62 is determined as a thin paper, the procedure proceeds to step S9, whereas when a type of the recording paper P is recognized as a regular paper or a heavy paper, the procedure proceeds to step S10. At step S9, the control unit 61 selects floating state, and the selected result is saved in the memory inside the apparatus, and then the procedure proceeds to step S11. At step 10, the control unit 61 selects grounded state, and the selected result is saved in the memory inside the apparatus, and then the procedure proceeds to step S11. At step S1, the control unit 61 compares the selected results saved in the memory inside the apparatus with each other. When the latest selected result is in floating state, the secondary transfer counter roller 32 is switched to floating state, whereas when the latest selected result is in grounded state, the procedure proceeds to step S12 with the secondary transfer counter roller 32 maintained in grounded state. At step S12, the printing means 66 performs printing process on a sheet of the recording paper P, and the procedure proceeds to step S13. At step S13, when the control unit 61 determines that there is a next page to be printed, the procedure goes to step S7, whereas when the control unit 61 determines that there is no page left to be printed, the procedure proceeds to step S14. At step S14, the secondary transfer roller is set to grounded state, and the image forming process of the image forming apparatus 1 ends.

As another embodiment, the following image forming apparatuses are possible. In a case where a plurality of pages contain the image information, in the image forming apparatus according to the aforementioned embodiment, on the basis of the detected humidity before the print request is recognized, grounded state or floating state is selected in the secondary transfer counter roller 32, and a type of the recording medium is detected on every page, and then, on the basis of the selected result, grounded state or floating state is selected in the secondary transfer counter roller 32. In an image forming apparatus according to another embodiment, a type of the recording medium and humidity are detected on every page and, on the basis of these selected results, grounded state or floating state is selected in the secondary transfer counter roller 32. Furthermore, the following image forming apparatus is also possible. After the print request is recognized, when the secondary transfer counter roller 32 is switched between grounded state and floating state, the image information which is recognized with the print request is printed out on all pages under the condition.

EXAMPLES

A description will be given hereinafter as to examples using the image forming apparatus 1.

Example 1

In Example 1, the image forming apparatus 1 is used under the following conditions. During the primary transfer, a voltage (a primary transfer voltage) which is applied from the primary transfer roller 35 to the intermediate transfer member 31 is 0.8 kV, and during the secondary transfer, an electric current (a secondary transfer current) which flows from the secondary transfer roller 36 to the recording paper P is 20 μA, and a voltage (a peeling voltage) which is applied from the peeling member 53 to the recording paper P on the conveying path is 0.7 kV, and a volume resistance value of the intermediate transfer member 31 is $1\times10^{11}$ Ω, and a surface resistance value of the intermediate transfer member 31 is $1\times10^{10}$ Ω·cm.

The peeling member 53 is a conductive felt ($1\times10^{7}$ Ω·cm).

Example 2

As the peeling member 53, the conductive felt ($1\times10^{7}$ Ω·cm) in Example 1 is replaced with a polyimide film (PI) ($1\times10^{9}$ Ω·cm). Other conditions are the same as those in Example 1.

Example 3

As the peeling member 53, the conductive felt ($1\times10^{7}$ Ω·cm) in Example 1 is replaced with an alpet. Other conditions are the same as those in Example 1.

Example 4

As the peeling member 53, the conductive felt ($1\times10^{7}$ Ω·cm) in Example 1 is replaced with a stainless-steel mesh. Other conditions are the same as those in the example 1.

Comparative Example 1

The peeling member 53 is not used. Other conditions are the same as those in Example 1.

Comparative Example 2

As the peeling member 53, the conductive felt ($1\times10^{7}$ Ω·cm) in Example 1 is replaced with an alpet having a saw tooth shape. Other conditions are the same as those in the example 1.

[Evaluation Method]

In accordance with Examples 1 to 4 and Comparative Examples 1 and 2, transfer efficiency and peeling performance were tested as follows. The results are shown in Table 1.

The alphabets such as "A", "B", "C", and "D" noted in a description of evaluation items hereinafter show the evaluation results used in the Table 1. "A" indicates "excellent", "B" indicates "practicable", "C" indicates "difficult for practical use", and the "D" indicates "very difficult for practical use".

(Transfer Efficiency)

An amount of toners transferred to the recording paper (on-recording-paper toner amount) and an amount of toners left on the intermediate transfer member which is not transferred to the recording paper (non-transferred toner amount), are measured. On the basis of the toner amount, the transfer efficiency is calculated in the following formula (1) and thus evaluated by the following criteria. Note that two types are evaluated. One type is a case where images to be printed on the recording paper are solid density images and another type is a case where images to be printed on the recording paper are halftone density images. As the recording paper, used is a humidity conditioning paper under high temperature and high humidity (35° C., 85%).

$$\text{Transfer efficiency (\%)} \quad \text{On-recording paper toner amount}/(\text{On-recording paper toner amount} + \text{Non-transferred toner amount})\times100 \tag{1}$$

"A" indicates that transfer efficiency is 95% or higher.

"B" indicates that transfer efficiency is higher than 90% and lower than 95%.

"C" indicates that transfer efficiency is higher than 85% and not higher 90%.

"D" indicates that transfer efficiency is 85% or lower.

(Peeling Performance)

The recording paper to be conveyed is visually observed by a camera disposed inside the apparatus and thus, the peeling performance is evaluated by the following criteria. As the recording paper, used is a thin paper having a basic weight of 52 g/m$^2$.

"A" indicates that the recording paper is smoothly conveyed to the fixing roller.

"B" indicates that the recording paper is not caught in the intermediate transfer unit, but peeling trouble causes troubles that an end of the recording paper is not finely timed to be fed, a conveying jam occurs in the conveying path, and the recording paper is obliquely fed.

"C" indicates that the recording paper is conveyed in a state of being attracted to the intermediate transfer member and consequently, the recording paper is caught in the intermediate transfer unit.

TABLE 1

| | Conditions | | | Results | | | | | |
|---|---|---|---|---|---|---|---|---|---|
| | | | | Transfer efficiency | | Peeling performance | | | |
| | Peeling member | Conditions for secondary transfer counter roller | | Regular paper | Thin paper | 1st time | 2nd time | 3rd time | Conveying jam |
| Example 1 | Conductive felt ($1 \times 10^7$ Ω · cm) | Insulating roller | Floating state | B | A | A | A | A | Not occur |
| | | | Grounded state | A | A | A | B | A | Not occur |
| | | Conductive roller | Floating state | A | A | A | A | A | Not occur |
| | | | Grounded state | A | B | C | C | A | Conveying trouble into fixing roller |
| Example 2 | Polyimide film (PI) ($1 \times 10^9$ Ω · cm) | Insulating roller | Floating state | B | A | A | A | A | Not occur |
| | | | Grounded state | A | B | C | A | A | Occur |
| | | Conductive roller | Floating state | A | A | A | A | A | Not occur |
| | | | Grounded state | A | D | C | C | C | Occur |
| Example 3 | Alpet | Insulating roller | Floating state | B | A | A | A | A | Not occur |
| | | | Grounded state | A | B | A | C | C | Occur |
| | | Conductive roller | Floating state | B | A | A | A | A | Occur |
| | | | Grounded state | A | B | C | C | A | Occur |
| Example 4 | Stainless-steel mesh | Insulating roller | Floating state | B | A | A | A | A | Not occur |
| | | | Grounded state | A | B | C | C | A | Occur |
| | | Conductive roller | Floating state | A | A | A | A | C | Occur |
| | | | Grounded state | A | D | A | C | C | Occur |
| Comparative Example 1 | Alpet (saw tooth shape) | Insulating roller | Floating state | C | D | C | C | C | Occur |
| | | | Grounded state | C | D | C | C | C | Occur |
| | | Conductive roller | Floating state | C | D | C | C | C | Occur |
| | | | Grounded state | C | D | C | C | C | Occur |
| Comparative Example 2 | No peeling member | Insulating roller | Floating state | B | D | C | C | C | Occur |
| | | | Grounded state | A | D | C | C | C | Occur |
| | | Conductive roller | Floating state | A | D | C | C | C | Occur |
| | | | Grounded state | A | D | C | C | C | Occur |

As shown in Table 1, when the peeling member 53 is a peeling member which can uniformly apply the electric field to the recording paper (Examples 1 to 4), adequate transfer efficiency is provided by switching the secondary transfer counter roller 32 to grounded state in a case of a regular paper. Moreover, in a case of a thin paper, adequate transfer efficiency is provided by switching the secondary transfer counter roller 32 to floating state and further, sufficient performance is also provided. Furthermore, when the peeling member 53 is a peeling member which can apply the electric field more uniformly to the recording paper (Examples 1 and 2), troubles such as conveying jam do not occur.

On the other hand, when the peeling member 53 is a peeling member which cannot apply the electric field uniformly to the recording paper (Comparative Example 1) and when the peeling member 53 is not used (Comparative Example 2), adequate transfer efficiency cannot be provided and sufficient peeling performance cannot be shown either.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

a plurality of photoreceptors on which toner images are formed;

a traveling intermediate transfer member to which a primary transfer is carried out such that a plurality of toner images are transferred to the traveling intermediate transfer member so as to be laminated thereon;

a secondary transfer roller disposed so as to be in contact with a side of the intermediate transfer member on which the toner images are laminated;

a secondary transfer counter roller disposed so as to confront the secondary transfer roller with the intermediate transfer member disposed inbetween, wherein a secondary transfer of the toner image on the intermediate transfer member to a recording medium which is being conveyed is carried out so that the recording medium and the traveling intermediate transfer member are sandwiched between the secondary transfer roller and the secondary transfer counter roller, further comprising:

switching means for switching the secondary transfer counter roller between grounded state and floating state; and a peeling member for applying an electric field to the recording medium so that the recording medium to which the toner image is transferred can be peeled off the intermediate transfer member.

2. The image forming apparatus of claim 1, further comprising:

type detecting means for detecting a type of the recording medium, wherein the switching means switches the secondary transfer counter roller between grounded state and floating state based on the type of the recording medium which is detected by the type detecting means.

3. The image forming apparatus of claim 2, wherein the switching means switches the secondary transfer counter roller to floating state in a case where the recording medium which is detected by the type detecting means is a thin paper.

4. The image forming apparatus of claim 2, wherein the switching means switches the secondary transfer counter roller to grounded state in a case where the recording medium which is detected by the type detecting means is a regular paper or a heavy paper.

5. The image forming apparatus of claim 1, further comprising:

humidity detecting means for detecting humidity inside the image forming apparatus, wherein the switching means switches the secondary transfer counter roller between grounded state and floating state based on the humidity inside the image forming apparatus which is detected by the humidity detecting means.

6. The image forming apparatus of claim 5, wherein the switching means switches the secondary transfer counter roller to floating state in a case where the humidity inside the image forming apparatus which is detected by the humidity detecting means is high.

7. The image forming apparatus of claim 5, wherein the switching means switches the secondary transfer counter roller to grounded state in a case where the humidity inside the image forming apparatus which is detected by the humidity detecting means is low.

8. The image forming apparatus of claim 1, wherein the peeling member is constituted so that electrical field can be uniformly applied to the recording medium.

9. The image forming apparatus of claim 1, wherein the switching means is composed of a relay or solenoid.

10. The image forming apparatus of claim 1, wherein the secondary transfer counter roller is a conductive roller.

11. The image forming apparatus of claim 1, wherein the secondary transfer roller is constituted so that transfer electrical field applied to the recording medium becomes constant in order to transfer the toner images laminated on the intermediate transfer member to the recording medium.

* * * * *